US005479792A

United States Patent [19]

Berg et al.

[11] Patent Number: 5,479,792

[45] Date of Patent: Jan. 2, 1996

[54] HEATING ARRANGEMENT

[75] Inventors: Bertil Berg, Sundsvall; Ralph Johansson, Alnö, both of Sweden

[73] Assignee: Sunds Defibrator Industries Aktiebolag, Sweden

[21] Appl. No.: 232,292

[22] PCT Filed: Oct. 5, 1992

[86] PCT No.: PCT/SE92/00694

§ 371 Date: May 6, 1994

§ 102(e) Date: May 6, 1994

[87] PCT Pub. No.: WO93/09391

PCT Pub. Date: May 13, 1993

[30] Foreign Application Priority Data

Nov. 6, 1991 [SE] Sweden ..... 9103263

[51] Int. Cl.[6] ..... D21C 1/02

[52] U.S. Cl. ..... 68/5 D; 68/6; 162/249; 162/250; 162/272

[58] Field of Search ..... 8/156; 68/5 D, 68/5 E, 6; 34/168, 225, 226; 162/46, 249, 250, 272; 99/516

[56] References Cited

U.S. PATENT DOCUMENTS

| | | | |
|---|---|---|---|
| 1,403,126 | 1/1922 | Lyth | 68/5 D X |
| 1,807,544 | 5/1931 | Morterud | 162/149 |
| 2,809,111 | 10/1957 | Durant et al. | 162/249 X |
| 3,293,119 | 12/1966 | Richter | 162/249 X |
| 3,319,275 | 5/1967 | Fleissner | 68/5 D X |
| 3,328,131 | 6/1967 | Latham, Jr. | 34/168 X |
| 3,680,334 | 8/1972 | Erickson et al. | 68/5 D |

FOREIGN PATENT DOCUMENTS

| | | |
|---|---|---|
| 0106460 | 4/1984 | European Pat. Off. . |
| 0275502 | 7/1988 | European Pat. Off. . |
| 0295180 | 12/1988 | European Pat. Off. . |

*Primary Examiner*—Philip R. Coe

*Attorney, Agent, or Firm*—Lerner, David, Littenberg, Krumholz & Mentlik

[57] ABSTRACT

Apparatus is disclosed for heating cellulosic pulp in a pipe including fittings mounted on the outer surface of the pipe, and steam pipes connected to the fittings to supply steam thereto, the pipe including a number of apertures at locations corresponding to the fittings so that the steam can pass therethrough.

12 Claims, 2 Drawing Sheets

HEATING ARRANGEMENT

FIELD OF THE INVENTION

The present invention relates to arrangements for heating material being conveyed through a pipe. More particularly, the present invention relates to arrangements or apparatus for heating material, preferably consisting of fibrous material in the form of a cellulosic pulp, as it is being conveyed through a pipe. Still more particularly, the present invention relates to such apparatus in which the heating medium is steam.

BACKGROUND OF THE INVENTION

In many instances it is necessary to heat a cellulose pulp for various purposes, such as to initiate and/or to continue different chemical reactions and treatments. This applies, for example, to many bleaching steps. In order to ensure this heating, steam of different pressures is generally used, depending upon the pressure level required by the process in the particular installation in question.

Heating of the pulp with steam preferably takes place in a pipe which is conveying the pulp to the treatment step in question. The pulp concentration can be from about 3 to 20%, and preferably from about 5 to 15%. In this manner, a relatively rapid and uniform heating of the pulp can be achieved. The steam is normally supplied through one or more steam pipes which are connected to the pulp pipe. Such so-called steam extension pipes connected to the pipe system can be designed in various ways, whereby the resultant temperature increase of the pulp can vary, and the functioning of subsequent machines will be more or less efficient.

In earlier systems or arrangements, problems have often arisen in view of the development of large steam bubbles on the inside of the pulp pipe. When these steam bubbles rapidly condense, condensate stresses and bangs occur, which cause harmful cavitations both in the pipe system itself and in surrounding components. Furthermore, it is difficult to achieve an entirely uniform temperature profile in the pulp. It is certainly possible to improve the temperature profile by inserting the steam pipes into the pulp pipe, but doing so will cause a considerable deterioration in the flow within the pulp pipe, as well as difficulties in cleaning the pulp pipe and steam pipes in case of plugging.

The aforesaid problems are solved by the present invention. As a result of this invention, the steam heating can take place effectively and uniformly since the steam is exposed to a large volume/surface of the passing pulp flow. Furthermore, the steam is supplied without any condensate bangs and without interfering with the pulp flow. The arrangement according to the present invention is also designed so that it can be easily cleaned when plugging of pulp takes place.

SUMMARY OF THE INVENTION

In accordance with the present invention, these and other objects have now been achieved by the invention of apparatus for heating fibrous material being conveyed through a pipe comprising a plurality of fitting members mounted on the outer surface of the pipe and extending along the outer surface of the pipe for a predetermined distance, and a corresponding plurality of steam pipes, each of the plurality of steam pipes being connected to each of the plurality of fitting members whereby steam is supplied to each of the plurality of fitting members, the pipe including a plurality of apertures at locations corresponding to each of the plurality of fitting members whereby steam can pass into the pipe therethrough.

In a preferred embodiment, the fibrous material is a cellulosic pulp.

In accordance with one embodiment of the apparatus of the present invention, each of the plurality of fitting members is disposed in the form of a helical curve on the outer surface of the pipe. In a preferred embodiment, the plurality of fitting members extend about the entire circumference of the pipe.

In accordance with one embodiment of the apparatus of the present invention, the plurality of fitting members have a semicircular cross-section. In another embodiment, the plurality of fitting members extend along the outer surface of the pipe at a predetermined angle with respect to the longitudinal direction of the pipe, preferably at an angle of between about 15° and 75°.

In accordance with another embodiment of the apparatus of the present invention, each of the plurality of fitting members has a first end and a second end, the first end of each of the plurality of fitting members being connected to the corresponding plurality of steam pipes, and including a plurality of cleaning pipes connected to the second end of each of the plurality of fitting members.

In accordance with another embodiment of the apparatus of the present invention, the pipe has a plurality of apertures and each of the plurality of apertures in the pipe includes a first end on the outer surface of the pipe and a second end on the inner surface of the pipe, the second ends of the plurality of apertures being wider than the first ends of the plurality of apertures. In a preferred embodiment, the plurality of apertures have a conical shape, preferably including a cone angle of from about 75° to 120°.

In accordance with another embodiment to the apparatus of the present invention, the plurality of apertures are arranged obliquely within the plurality of fitting members with respect to the direction of flow of the fibrous material in the pipe.

In accordance with a preferred embodiment of the apparatus of the present invention, the apparatus includes a corresponding plurality of cyclones connected to the plurality of cleaning pipes for separating fibers from the steam, and a corresponding plurality of stop valves disposed between the plurality of cyclones and the second end of the plurality of fitting members.

BRIEF DESCRIPTION OF THE DRAWINGS

The following detailed description can be more easily understood with reference to the Figures, in which.

DETAILED DESCRIPTION

Figure 2:
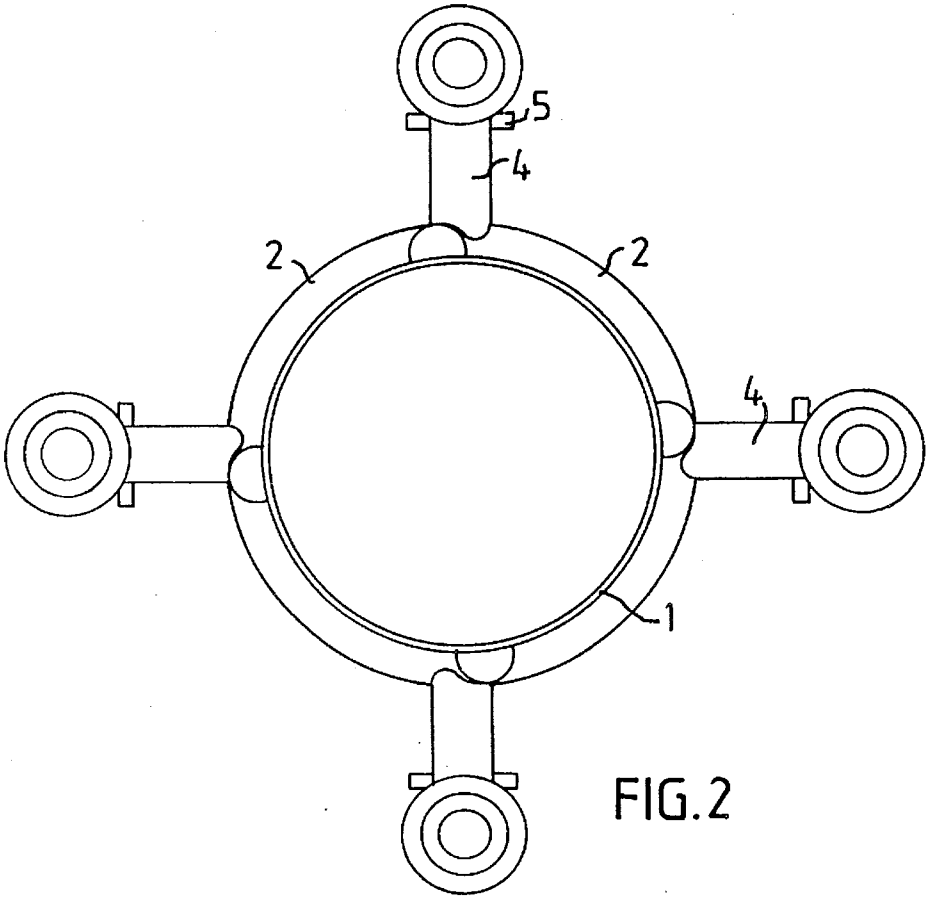
FIG. 2 is a front, cross-sectional view of the apparatus of the present invention.
Figure 1:
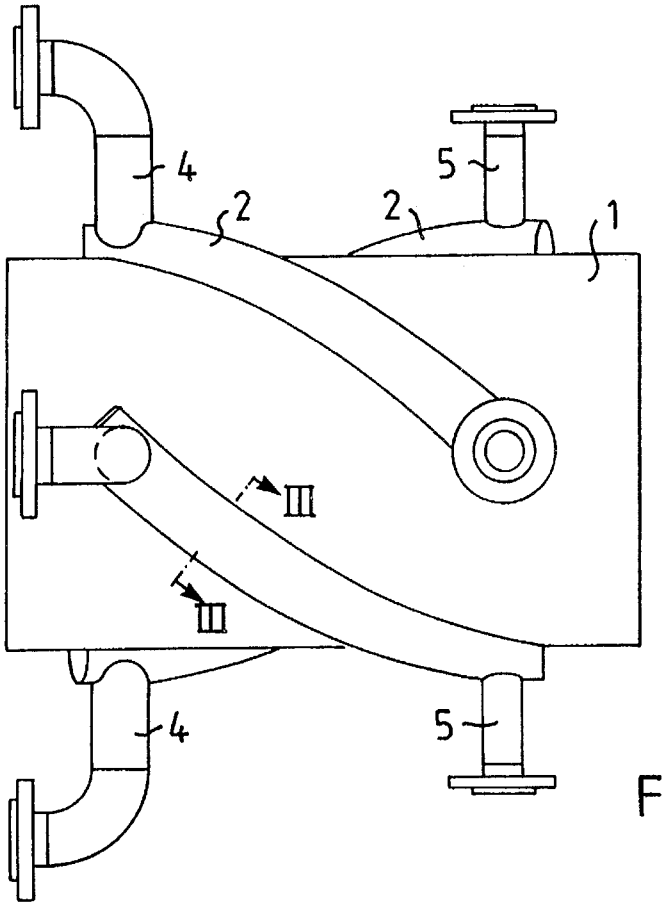
FIG. 1 is a side, elevational view of one embodiment of the apparatus of the present invention.
Figure 3:
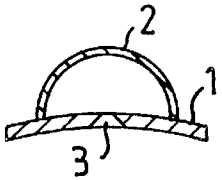
FIG. 3 is a cross-sectional view of the portion of the apparatus shown in FIG. 1 taken along view III—III thereof.

Referring to the Figures, in which like numerals refer to like portions thereof, FIG. 1 shows a portion of a conveying pipe 1 for pulp. A number of fittings 2 are attached to the pipe 1, preferably by welding. The fittings preferably have a semicircular cross-section, and are arranged in a helical curve on the outer surface of the conveying pipe 1. The fittings form an angle of between about 15° and 75°, preferably between about 30° and 60°, with respect to the longitudinal direction of the conveying pipe. The number of fittings and the angles thereof are adapted so that, taken together, the fittings extend about the entire circumference of the conveying pipe. According to the particular embodiment shown in FIG. 1, the fittings are four in number and the angle is about 45°.

In the wall of the conveying pipe a plurality of small inlet holes 3 for the steam are arranged in each fitting 2. These holes are located along the length of the fitting. The holes 3 are formed so as to widen toward the inside of the conveying pipe 1. The holes preferably have a conical shape, with a cone angle of between about 75° and 120°. The hole size can be, for example, about 10 mm in the narrowest portion. Alternatively, the holes can be arranged obliquely inward with respect to the flow direction of the pulp.

A steam pipe 4 for the supply of steam is connected to the end of the fittings in an upstream location with respect to the direction of flow of the pulp. Cleaning pipes 5 are connected to the other end of the fittings 2, and then cleaning pipes 5 are closed when the apparatus is in operation.

The steam supplied through the steam pipes 4 is distributed along the fittings 2 and flows into the conveying pipe 1 through the inlet holes 3. Due to the configuration of this arrangement, the steam is exposed around the entire circumference of the pulp flow, while at the same time the supply of steam is distributed in the direction of flow of the pulp. In this manner, the temperature of the pulp can be increased within a relatively short distance along the conveying pipe, and at the same time the small inlet holes 3 prevent the development of large steam bubbles, with its resultant detrimental cavitations. The heating thus has a uniform temperature profile, and the pulp flow is not hindered.

Due to the conical shape of the holes, including an inwardly increasing diameter, the steam jets will reach the center of the conveying pipe, and the risk of plugging with pulp is eliminated to the greatest possible extent. If there were a possible pressure drop in the steam supply, the pulp would tend to pierce out through the holes 3. The shape of the holes renders it difficult for the pulp to get through the holes. However, if holes and fittings are plugged, cleaning can take place simply by blowing steam through the cleaning pipes 5.

Figure 4:
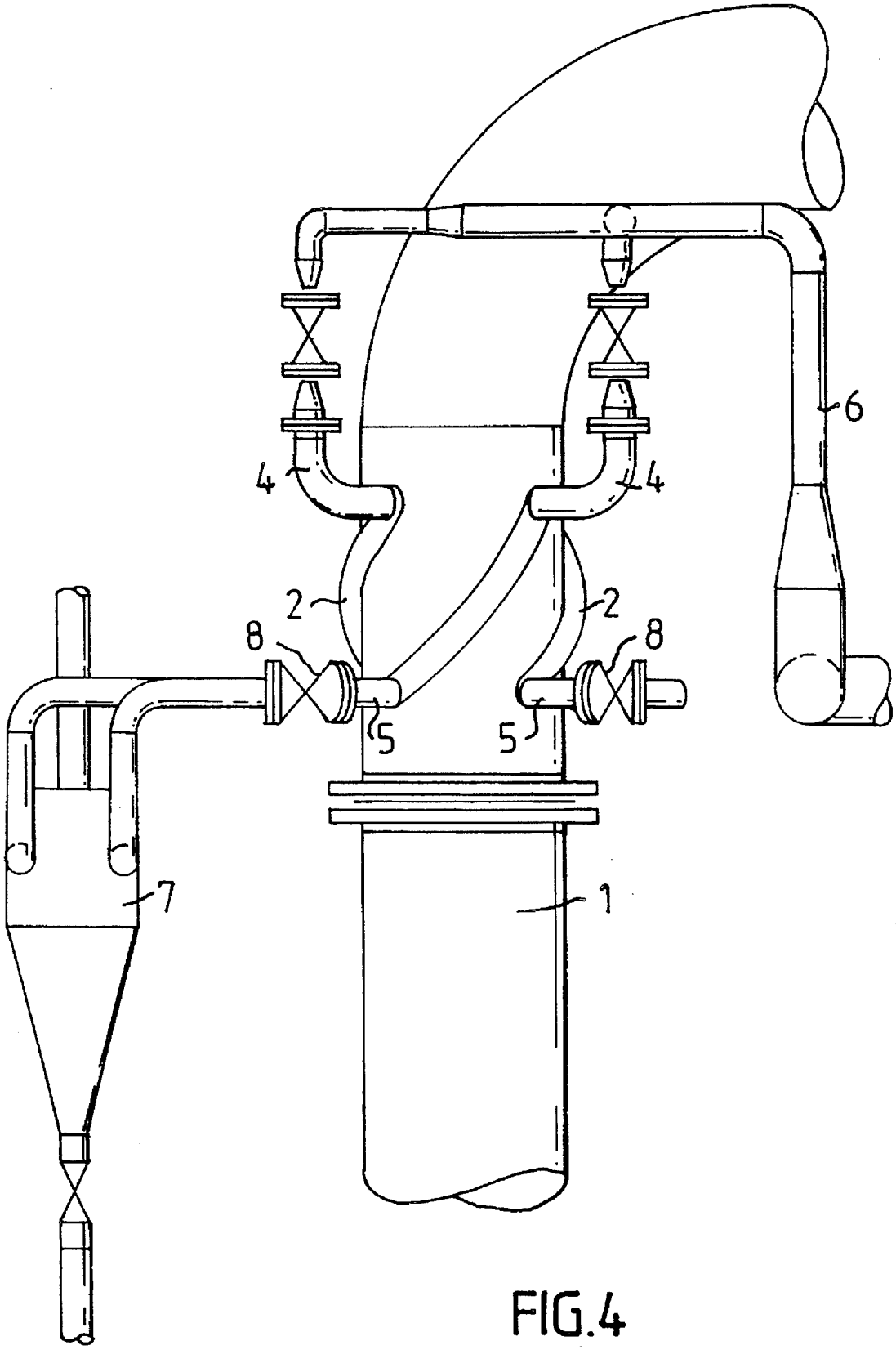
FIG. 4 is a top, perspective view of an installation of an apparatus in accordance with the present invention.

The installation shown in FIG. 4 comprises a conveying pipe 1 in which the steam pipes 4 are connected to a steam supply pipe 6. The cleaning pipes 5 in this case are connected to a cyclone 7 for separating fibers from the steam. Stop valves 8 are located in the cleaning pipes 5. The pulp is heated, as described above, by steam supply via the steam pipes 4. If, for some reason, pulp should penetrate out through the inlet holes 3 to the fittings 2, cleaning can be effected by opening one or more of the valves 8. The steam supplied in this manner will then flow through the corresponding fitting 2 out through the cleaning pipe 5 to the cyclone 7. The pulp thereby follows along, and the inlet holes 3 are exposed. In the cyclone 7 the pulp is then separated from the steam. The cyclone 7 thus begins to operate only during cleaning of the apparatus by blowing.

This installation renders it easy to clean the apparatus even when it is in operation. The stop valves 8, for example, can be opened one at a time for cleaning as soon as there is a tendency of plugging, thereby reducing interruption of the operation to the smallest possible extent.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. Apparatus for heating fibrous material being conveyed through a pipe comprising a plurality of fitting members mounted on the outer surface of said pipe, each of said plurality of fitting members being disposed in the form of a helical curve on said outer surface of said pipe, and a corresponding plurality of steam pipes, each of said plurality of steam pipes being connected to a corresponding fitting member whereby steam is supplied to each of said plurality of fitting members, said pipe including a plurality of apertures at locations corresponding to each of said plurality of fitting members whereby steam can pass into said pipe therethrough.

2. The apparatus of claim 1 wherein said fibrous material comprises cellulosic pulp.

3. The apparatus of claim 1 wherein said plurality of fitting members have a semicircular cross-section.

4. The apparatus of claim 1 wherein said plurality of fitting members extend along said outer surface of said pipe at a predetermined angle with respect to the longitudinal direction of said pipe.

5. The apparatus of claim 4 wherein said predetermined angle is between about 15° and 75°.

6. The apparatus of claim 1 wherein said plurality of fitting members extends about the entire circumference of said pipe.

7. The apparatus of claim 1 wherein each of said plurality of fitting members has a first end and a second end, said first end of each of said plurality of fitting members being connected to said corresponding steam pipe, and including a plurality of cleaning pipes connected to said second end of each of said plurality of fitting members.

8. The apparatus of claim 7 including a corresponding plurality of cyclones connected to said plurality of cleaning pipes for separating fibers from said steam, and a corresponding plurality of stop valves disposed between said plurality of cyclones and said second end of said plurality of fitting members.

9. The apparatus of claim 1 wherein said plurality of apertures in said pipe includes a first end on said outer surface of said pipe and a second end on said inner surface of said pipe, said second ends of said plurality of apertures being wider than said first ends of said plurality of apertures.

10. The apparatus of claim 9 wherein said plurality of apertures have a conical shape.

11. The apparatus of claim 10 wherein said conical shape includes a cone angle of from about 75° to 120°.

12. The apparatus of claim 1 wherein said plurality of apertures are arranged obliquely within said plurality of fitting members with respect to the direction of flow of said fibrous material in said pipe.

* * * * *